US005142705A

United States Patent [19]

Edwards

[11] Patent Number: 5,142,705

[45] Date of Patent: Sep. 1, 1992

[54] ADJUSTABLE HEADBAND FOR BASEBALL HELMET

[76] Inventor: John W. Edwards, 920 Martha Ave., Lancaster, Pa. 17601

[21] Appl. No.: 700,409

[22] Filed: May 15, 1991

[51] Int. Cl.[5] ..... A42B 3/00; A42B 1/22

[52] U.S. Cl. ..... 2/418; 2/183; 2/197

[58] Field of Search ..... 2/417, 418, 419, 197, 2/183, 181, 416

[56] References Cited

U.S. PATENT DOCUMENTS

| | | | |
|---|---|---|---|
| 1,725,425 | 8/1929 | Steingold | 2/183 X |
| 1,894,213 | 1/1933 | Ostolaza | 2/183 |
| 2,923,942 | 2/1960 | Lee et al. | 2/418 |
| 4,011,600 | 3/1977 | Malk | 2/183 |
| 4,101,981 | 7/1978 | Boden | 2/197 X |
| 4,117,554 | 10/1978 | Palumbo | 2/418 |
| 4,885,806 | 12/1989 | Heller | 2/425 |

*Primary Examiner*—Peter Nerbun
*Attorney, Agent, or Firm*—Richard C. Litman

[57] ABSTRACT

An adjustable headband for a baseball helmet, attached to the helmet over the left and right ears and at the front center of the helmet. The free end of the headband passes around the rear of the wearer's head and through guide or belt loops and through an opening in said helmet, whereby said headband may be adjusted by the wearer while the helmet is being worn. Subsequent to adjustment the headband free end is attached to the outside of the helmet by a Velcro or other conventional fastener. The headband may be made of any suitable material including leather, nylon web, or injection-molded plastic, or any combination thereof.

4 Claims, 1 Drawing Sheet

ADJUSTABLE HEADBAND FOR BASEBALL HELMET

BACKGROUND OF INVENTION

1. Field of the Invention

This invention relates to an adjustable headband for a baseball helmet wherein the adjustment may be made by the wearer while the helmet is worn.

Baseball players and others engaged in similar endeavors have been injured in the past when pitched or batted balls come into violent contact with the head of the player. Attempts have been made to protect the players by providing protective helmets. These helmets have headbands which are either custom made to fit individual heads or are adjusted by a trial and error method, often without the greatest accuracy since such adjustment has to be made while the helmet is not worn.

2. Description of Related Prior Art

Safety helmets for baseball players and others who may have a need for such protection are well known in the prior art. U.S. Pat. No. 2,218,947 issued Oct. 22, 1940 to Victor Brunzell discloses a safety cap for ball players comprising a head band of fixed circumference which is not adjustable. U.S. Pat. No. 2,420,937 issued May 20, 1947 to John F. Dauster discloses protective headgear having a headband which can be adjusted only by restapling the ends of the headband on a trial and error basis. The adjustment disclosed by Dauster cannot be achieved while the protective headgear is being worn. U.S. Pat. No. 2,739,310 issued Mar. 27, 1956 to Leonard P. Frieder and Walter S. Finken discloses safety headgear structure including a headband arrangement which may be adjusted while the headgear is worn by means of an externally accessible thumb wheel which can rotate right and left-hand threaded shafts to cause translation of internally threaded lugs attached to the respective ends of the headband. The adjustment is limited to the length of the respective threaded shafts. U.S. Pat. No. 3,241,154 issued Mar. 22, 1966 to Jackson A. Aileo discloses safety helmets having headbands which are made adjustable through a variety of ways including Velcro type fasteners and adjustable buckle arrangements. Each of the adjustments however are by way of trial and error while the helmets are not being worn. U.S. Pat. No. 3,994,023 issued Nov. 30, 1976 to Jackson A. Aileo and Leonard P. Frieder, Jr. discloses a simplified protective helmet assembly with a headband being formed by means of a plurality of independent pads being placed inside the helmet at different heights by Velcro-like fasteners, the variance in height providing the adjustment of the headband assembly. U.S. Pat. No. 4,843,642 issued Jul. 4, 1989 to Richard A. Brower discloses a combat vehicle crewman helmet which discloses a plurality of adjustable straps and a drawstring arrangement provided for the purpose of securing protective material to a user's head.

SUMMARY AND OBJECTS OF THE INVENTION

It is an object of this invention to provide a baseball helmet with a headband which may be adjusted by the wearer while the helmet is being worn.

It is another object of this invention to provide a baseball helmet with an adjustable headband whereby manufacturing costs may be substantially reduced by limiting manufacture of the helmet and headband to a single uniform size.

Still another object of this invention is to provide an adjustable headband which may be used with a variety of safety helmets.

The foregoing objects are achieved by providing an elongated headband attached at one end to a safety helmet over the left ear, attached again to the center front of the safety helmet, and also attached to the safety helmet over the right ear. The headband continues around the rear of the head from the vicinity of the right ear and through belt loops or guides attached to the outer surface of the headband in the vicinity of the left ear and the center front of the safety helmet. The free end of the headband then passes through a slot to the outside of the helmet in the vicinity of the right ear. The free end of the headband and the right side of the helmet are provided with cooperating Velcro or other conventional fastening means. To adjust the headband while the helmet is being worn, the wearer would hold the visor of the helmet with his or her left hand and pull on the free end of the headband with the other hand and thereafter lock the headband in adjusted position by means of the Velcro or other conventional fastener. The headband may be made of leather, nylon, or injection-molded plastic or any combination thereof. Further, while the adjustable headband is shown to be used with a baseball helmet, it may also be substituted for headbands in other types of safety helmets.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
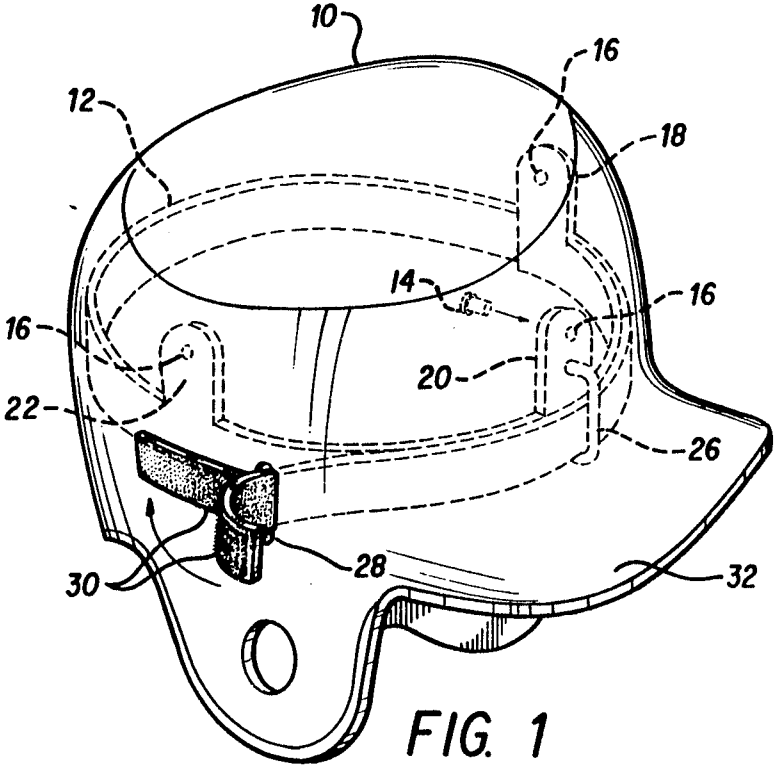
FIG. 1 is a perspective view of a baseball helmet incorporating the adjustable headband mounted therein.
Figure 2:
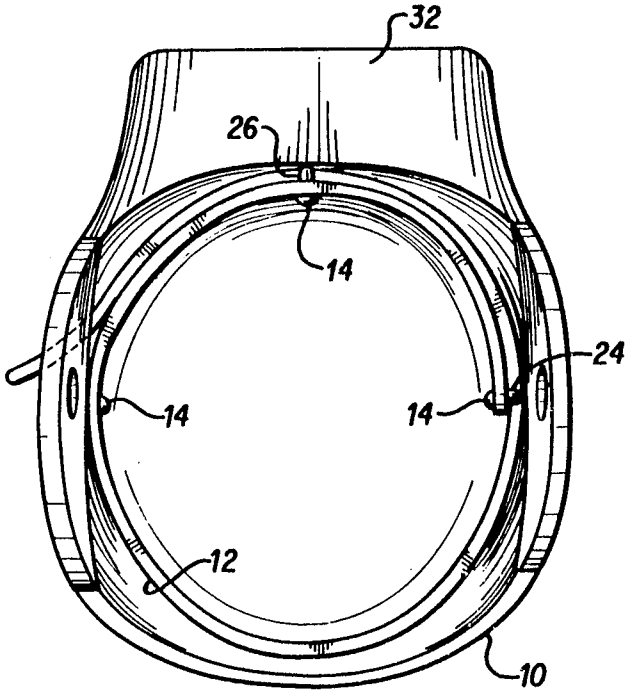
FIG. 2 is a bottom view of the baseball helmet of FIG. 1 showing the arrangement of the adjustable headband within the baseball helmet.
Figure 3:
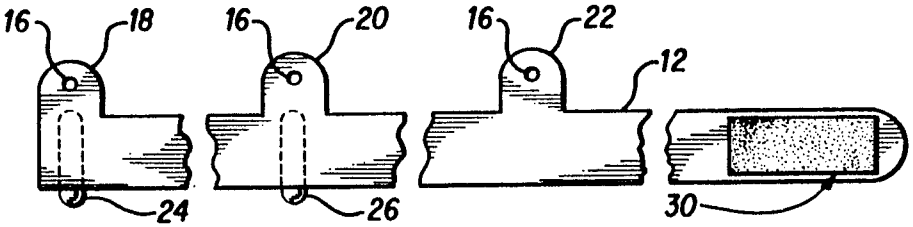
FIG. 3 is a plan view of the adjustable headband prior to mounting within the baseball helmet.

In FIG. 1 there is shown a baseball helmet 10 having an adjustable headband 12 mounted therein by means of rivets or the like 14, which are inserted through holes 16 provided in upwardly extending flaps 18, 20 and 22 of headband 12 to attach adjustable headband 12 to helmet 10. Flap 18 is attached to helmet 10 over the left ear, flap 20 is attached to helmet 10 at the center front of the helmet, and flap 22 is attached to helmet 10 over the right ear. The remainder of headband 12 circles around the rear of the user's head and then passes through belt guides or loops 24 and 26 located externally of headband 12 on flaps 18 and 20, respectively, as shown in FIGS. 1, 2, and 3. The end of headband 12, after passing through belt guides or loops 24 and 26, exits helmet 10 through a slot 28, to be fastened to the outer surface of helmet 10 by Velcro closure 30 or other conventional fastening means.

To use helmet 10, the player unfastens the Velcro closure 30 on the outside of helmet 10. He then opens headband 12 using his thumbs until headband 12 fits over his head. After putting helmet 10 on, the player grasps visor 32 with his left hand and pulls the exposed portion of headband 12 with his right hand, pulling headband 12 snug around his head. The player then refastens the Velcro closure 30 or other conventional fastening means.

The advantages of the disclosed headband 12 is in its ability to adjust quickly to any size head, and its ease of operation. Headband 12 can be made of any suitable material, including but not limited to leather, nylon web, or injection molded plastic or any combination thereof. Further, while guide elements 24 and 26 are disclosed to be belt loops, particularly suitable for headbands formed of leather, such guide elements may also be U-shaped when used with plastic materials. The free ends of the headband may have decorations thereon if desired, or be variously colored. Additionally, other types of conventional fasteners may be substituted for Velcro closures 30. It is important to note that the adjustment of the headband occurs at the rear of the head, flaps 18, 20 and 22 remaining fixed to the helmet shell.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. An adjustable headband for a helmet such as a baseball helmet to be worn on a head of a user, comprising:

an elongated band means;

means for attaching said elongated band means to an inner surface of said helmet at three locations thereon;

guide means located on said attaching means adjacent two of said three locations, said guide means extending between said elongated band means and said helmet to guide a free end of said elongated band means around said user's head in overlapping fashion;

slot means on said helmet through which said free end of said elongated band means passes outside of said helmet; and closure means on said free end of said elongated band means and externally on said helmet; whereby said headband may be adjusted relative to the user's head to provide a snug fit of the headband on the user's head while being worn by the user, by moving said free end of said elongated band means relative to said slot means and thereafter engaging the closure means on said free end of said elongated band means with the closure means externally on said helmet.

2. An adjustable headband as in claim 1 wherein said means for attaching comprises:

three upwardly directed flap means on said elongated band means, two of said flap means being disposed in said helmet above the right and left ears, respectively, and the third flap means being located in a front center section of said helmet; and fastening means for attaching said three flap means to said helmet.

3. An adjustable headband as in claim 2, said guide means being located on the side of said flap means over the left ear and said front center section toward said helmet, whereby said free end of said elongated band means may be shifted relative to said flap means without damage to the user's skin.

4. An adjustable headband as in claim 1, the elongated band means being formed of material selected from a group consisting of leather, nylon web and injection-molded plastic.

* * * * *